US006283290B1

(12) United States Patent
Thompson

(10) Patent No.: US 6,283,290 B1
(45) Date of Patent: Sep. 4, 2001

(54) RAIN COVER FOR A GOLF BAG

(76) Inventor: John L. Thompson, 1467 S. Highview La., #213, Alexandria, VA (US) 22311

( * ) Notice: Subject to any disclaimer, the term of this patent is extended or adjusted under 35 U.S.C. 154(b) by 0 days.

(21) Appl. No.: 09/321,854

(22) Filed: May 28, 1999

(51) Int. Cl.[7] ..... A63B 55/00
(52) U.S. Cl. ..... 206/315.4; 150/159
(58) Field of Search ..... 150/159; 206/315.4

(56) References Cited

U.S. PATENT DOCUMENTS

| | | | | |
|---|---|---|---|---|
| D. 256,293 | * | 8/1980 | Edwards | 150/159 |
| 2,973,794 | * | 3/1961 | Erickson | 150/159 |
| 3,059,681 | * | 10/1962 | Lorbeski | 206/315.4 |
| 3,913,648 | * | 10/1975 | Sessler | 150/159 |
| 3,977,451 | | 8/1976 | Duba . | |
| 4,234,025 | | 11/1980 | Berge . | |
| 4,442,937 | * | 4/1984 | Delauder | 206/315.4 |
| 4,498,579 | * | 2/1985 | Brick | 206/315.4 |
| 4,512,465 | * | 4/1985 | Jobe | 206/315.4 |
| 4,522,300 | * | 6/1985 | Hamblet | 206/315.4 |
| 4,657,135 | | 4/1987 | Kjose . | |
| 4,788,996 | * | 12/1988 | Forshee | 206/315.4 X |
| 5,058,642 | | 10/1991 | Tuntland . | |
| 5,131,442 | | 7/1992 | Bevier . | |
| 5,226,464 | | 7/1993 | Solov . | |
| 5,383,505 | | 1/1995 | Cordasco, Jr. . | |
| 5,490,594 | | 2/1996 | Rupe . | |
| 5,507,332 | | 4/1996 | McKinnon . | |
| 5,704,475 | | 1/1998 | Jack . | |
| 5,718,333 | * | 2/1998 | Armour | 206/315.4 |
| 5,819,829 | * | 10/1998 | Mattews | 150/159 |
| 5,862,910 | * | 1/1999 | Dahsten | 150/159 X |
| 5,904,195 | * | 5/1999 | Doig | 206/315.4 X |

* cited by examiner

*Primary Examiner*—Stephen P. Garbe
*Assistant Examiner*—Tri M. Mai
(74) *Attorney, Agent, or Firm*—Reed Smith Hazel & Thomas LLP

(57) ABSTRACT

A cover assembly for a golf bag comprising a hood assembly including a support frame comprising a plurality of ribs which are at least partially formed from a flexible, resilient material and structured relative to one another to normally orient or bias the hood assembly into a closed position defined by overlying, enclosing relation to an open end of the golf bag as well as golf clubs extending therethrough in the conventional manner. The hood assembly may be defined by at least two hood segments either one of which may be selectively positionable in spaced relation to the other so as to define an open position which allows access by a player to the clubs for removal thereof through the open end. The support frame and in particular, the flexible, resilient material ribs are cooperatively structured with the remainder of the hood assembly such that the hood assembly may be selectively disposed in a stored position which is at least partially defined by a greatly reduced dimension and configuration such that the hood assembly, once removed from the golf bag, may be positioned within a casing to facilitate storage and carrying of the hood assembly when not in use.

24 Claims, 6 Drawing Sheets

RAIN COVER FOR A GOLF BAG

FIELD OF THE INVENTION

This invention relates to a protective cover assembly which is removably attached to the open end of a golf bag in substantially complete covering relation to a plurality of golf clubs disposed within the golf bag and extending upwardly through the open end of the golf bag. More in particular, the protective cover assembly of the present invention includes a hood assembly which is structured to remain in a substantially if not completely closed position when disposed in an operative position on the golf bag, until access to the golf clubs is desired, whereupon, the hood assembly can be easily and generally momentarily moved into an open position. Further, the protective cover assembly may also be disposed in a stored position when detached from the golf bag and not in use.

DESCRIPTION OF THE RELATED ART

The game of golf has enjoyed increasing popularity for many years and is played on the recreational, amateur and professional levels by both men and women. Regardless of the level of play, the equipment required to participate typically involves a plurality of golf clubs housed or carried in a golf bag. As can be seen with reference to FIG. 1-A, labeled "Prior Art," the conventional golf bag has a generally elongated configuration and although each may vary somewhat in design, color, size, etc., each typically shares certain common features. For instance, golf clubs are carried in the golf bag with the handles positioned inside the bag at the bottom so that the heads of the golf clubs extend upwardly and outwardly from the open end of the golf bag. The clubs heads are displayed through the open end of the golf bag so that the player can make an intended club selection depending upon the golf shot required. While the quality of the clubs utilized will naturally vary depending upon the seriousness of the golfer and his or her competitive level, a good set of golf clubs are a relatively expensive purchase, and accordingly, should be well cared for during both play and storage. Still referring to FIG. 1-A, it is also common for a golf bag to include one or more handles, typically securely attached thereto for carrying of the bag and clubs about a golf course. Also, many golf bags can be adapted to include additional structure, such as a pair of leg members on a forward portion of the bag, to permit the bag to assume a tripod position on the ground.

Golf is generally considered to be a "fair weather" sport in that play is suspended or prohibited during relatively harsh weather conditions such as thunder and lightening storms, driving rain and the like. However, due to the competitive nature of the game, golfers will often continue to play during marginal weather conditions such as during a relatively light rain or even snow. During such times, it is common practice to protect the golf clubs contained within the golf bag, and in that vein, to preferably protect the entire golf club from getting wet and slippery, and thereby, negatively impacting a golfer's swing.

Accordingly, some rain covers have been developed to provide protection not only to the head portion of the golf clubs, but also to the interior of the golf bags, and thus, for keeping the shaft and handle portions of each golf club within the bag dry as well. For example, there are numerous types of rain covers known in the art designed to be draped or otherwise disposed over the golf club heads in covering or enclosing relation thereto. While such known protective covers are generally considered to be adequate to accomplish their protective function, certain disadvantages exist which render their use undesirable or less desirable. For instance, some of these protective golf bag covers extend entirely about the golf bag and golf clubs extending therefrom, although others are removably secured about the open end of the golf bag. Such covers often do not facilitate ready access to the golf clubs within a golf bag, and consequently, accessing the golf clubs usually requires some disengagement of the rain cover from the golf bag, thereby exposing the golf clubs, as well as the interior of the golf bag, to the rain.

Even when such known rain covers do not require a complete removal from the golf bag to provide access, the golf clubs and/or the interior of the bag is still likely to become wet, as rain is often accompanied by windy conditions. To the other extreme, some rain covers have been designed for a golf bag which do not require full or partial removal therefrom, and most, if not all of these types provide a movable flap on the rain cover for accessing the golf clubs. However, the known rain covers with movable flaps are either too small to facilitate easy selection and removal of the appropriate golf club for the intended shot or are too large to provide adequate protection from rain, regardless of whether accompanied by wind or not. Yet others have designed rain covers for a golf bag which utilize zippers, snaps, and similar fasteners, but such fasteners are generally cumbersome and time consuming to manipulate and frequently, result if not in a poor fitting rain cover, then in the golfer's eventual non-use thereof out of frustration.

Other disadvantages associated with known rain covers for golf bags include an ineffective means of attachment and detachment from the golf bag. That is, in order to maintain a rain cover in its intended protective position on the golf bag, the means of attachment thereto must be reasonably secure so that when access to the golf clubs is attempted, the rain cover will remain in the. intended protective position. Many of the known rain covers become dislodged from the intended position when the golfer retrieves or replaces a golf club from or to the golf bag, thereby exposing the clubs to the elements. Further, many known rain covers for a golf bag are themselves bulky and not capable of being easily stored and carried. Consequently, those types of rain covers are often left behind during a golf outing, and should the weather change unexpectedly, as it can do during the four hours or so that it takes to play eighteen holes of golf, the player's golf clubs are again exposed to the elements.

Accordingly, there is a need in the sport of golf for a protective cover assembly which is structured to be removably attached to a conventional golf bag, regardless of minor differences in size or configuration, in a manner which will offer substantially complete protection to the head, shaft and handle of the golf clubs, as well as to the interior of the golf bag, during adverse weather conditions. Any such protective cover assembly should be capable of being easily attached and detached from an operative, protective position on the golf bag, and further, should be capable of being reduced to compact form so as to be easily stored and carried in a convenient location, such as in a pouch on the golf bag itself, during periods of non-use. In addition, any such protective cover assembly should provide easy and quick access to the golf clubs within the golf bag in order to facilitate the selection of an appropriate club, while at the same time, significantly restricting exposure of the golf clubs to the elements, during club selection. In addition to the above, any such protective cover assembly should also incorporate a base or other equivalent support frame structure which adequately secures the protective cover assembly to the club bag in an intended protective position, so as to remain in that position whenever a golf club is selected, removed and/or returned from or to the golf bag. Any such support frame should also be structured to facilitate access to the clubs while limiting exposure to rain, etc. and further to not interfere with or otherwise impede the selection, removal and/or return of a golf club from or to the golf bag.

SUMMARY OF THE INVENTION

The present invention has been developed in order to solve the needs which remain in the art. More specifically, the present invention relates to a protective cover assembly for a golf bag that is designed to protect the golf clubs contained within the bag, as well as the interior portions of the golf bag, from exposure to rain and other adverse conditions. The protective cover assembly of the present invention is also structured to facilitate easy access to the golf clubs for proper club selection while being reliably maintained in an operative position on the golf bag.

The protective cover assembly of the present invention comprises a hood assembly including a base and a mounting assembly which facilitates secure, yet removable attachment of the invention to the golf bag, substantially adjacent an open upper end thereof. The hood assembly includes a support frame and a cover structure. The support frame preferably comprises a plurality of rib structures, each formed at least in part from a flexible, resilient material and having an elongated configuration with opposite ends secured to the base in a fixed location. Further, each of the rib structures are structured and disposed to extend upwardly from opposite sides of the golf bag and across to span, in overlying relation to the open end of the golf bag and any golf clubs extending therefrom, so as to assume a generally arcuate and hood like configuration. The rib structures are further disposed in spaced relation to one another with a cover structure, preferably in the form of a weather proof, water impermeable material, secured in overlying relation and in attached relation to each of the plurality of rib structures defining the support frame. Because of the configuration of each of the rib structures, the cover structure is supported in an overlying, at least partially enclosing, relation to the open end of the golf bag when the hood assembly is disposed in its operative, protective position. The flexibility of the material from which the cover structure is formed allows the cover structure to assume the aforementioned protective position but, also to be easily moved and folded when the rib structures are moved relative to one another between what may be defined as an open and closed position of the hood assembly.

In a preferred embodiment of the present invention, the hood assembly comprises two hood segments, each having a support frame structured to include a plurality of rib structures and a cover segment disposed in supported, overlying relation thereon and across and further defining each hood segment. When disposed in the operative, closed and protective position, each of the hood segments includes an open face as well as an open bottom. The open bottom of each hood segment is disposed in direct communicating relation with the open end of the golf bag such that the head portions of the golf clubs extend through the open end of the golf bag and into the "interior" of the hood assembly defined by the cooperatively positioned hood segments.

As set forth above, the hood assembly may be positioned between a closed position and an open position. In the preferred embodiment, the closed position is defined by the open faces of each hood segment being disposed in substantially confronting relation to one another. Further, one of the two hood segments is preferably larger in dimension and specifically configured to somewhat overlap the smaller of the two hood segments, when the hood assembly is in the aforementioned closed position. Selective positioning, by manual manipulation, of either one or both of the hood segments, into the open position is accomplished by moving an uppermost one of the rib structures defining such hood segments downwardly and into an adjacent rib structure so as to "collapse" them together and into somewhat of a stacked configuration. Thereupon, a space or void between the open faces of the hood segments is presented so that the player may have clear access to the clubs contained within the golf bag, while still maintaining the clubs in somewhat of a protected position because of the overlying or enclosing disposition of at least one of the two hood segments.

In another embodiment of the present invention, a skirt structure may be formed of a like material of the cover structure and disposed in surrounding, depending relation to the base so as to overlie an outer surface of the golf bag, substantially surrounding the open end thereof. In such an embodiment, at least one but preferably a plurality of openings can be formed in the skirt portion which are structured to allow passage therethrough of a handle, shoulder strap, supporting leg members or other components of the golf bag.

Accordingly, it is a primary object of the present invention to provide a protective cover assembly for removable attachment to an open end of a golf bag in substantially complete covering relation to a plurality of golf clubs disposed within the golf bag and which extend upwardly through the open end of the golf bag.

Another primary object of the present invention is to provide a protective cover assembly for a golf bag which incorporates a support frame structured to support a cover structure in overlying, at least partially enclosing relation to an open end of a golf bag with golf clubs contained therein.

Another primary object of the present invention is to provide a protective cover assembly for a golf bag which i s s electively positionable between a closed position and an op en position wherein the open position provides clear and easy access to the golf clubs within the golf bag while preventing unnecessary exposure of the golf clubs to rain or other adverse weather conditions.

Yet another primary object of the present invention is to provide a protective cover assembly for a golf bag having a support frame and cover structure structured to remain in a substantially closed and protective position when disposed on the golf bag, until access to the golf clubs is desired, whereupon, the support frame and cover structure can be easily and generally momentarily moved into an open position, and thereafter, the support frame and cover structure will automatically return to the closed protective position.

Yet another important object of the present invention is to provide a protective cover assembly for a golf bag which is structured to be removably attached to a conventional type of golf bag, regardless of the relatively minor differences in size and/or configuration.

Still another important object of the present invention is to provide a protective cover assembly for a golf bag which is readily attachable or detachable in its intended position regardless of the overall configuration of the golf bag or the size thereof.

It is also an important object of the present invention to provide a protective cover assembly including a skirt portion which is structured to accommodate the fixed or other placement of a handle, shoulder strap, support structure or the like, associated with many types of golf bags.

Yet another important object of the present invention is the provision of a protective cover assembly for a golf bag which is structured to be selectively disposed into a stored position defined by a significantly reduced size and configuration to facilitate storage and/or transport of the cover assembly when not in use.

Yet another object of the present invention is to provide a protective cover assembly for a golf bag which incorporates a casing for containment of the cover assembly when in a stored position.

These and other objects, features and advantages of the present invention will become more clear when the drawings, as well as the detailed description of the preferred embodiments, which follows, are taken into consideration.

BRIEF DESCRIPTION OF THE DRAWINGS

For a fuller understanding of the nature of the present invention, reference should be had to the following detailed description taken in connection with the accompanying drawings in which:

FIG. 1 is a perspective view of the protective cover assembly of the present invention in a preferred embodiment and disposed in an operative closed, protective position on the open end of a golf bag.

Like reference numerals refer to like parts throughout the several views of the drawings.

DETAILED DESCRIPTION OF THE PREFERRED EMBODIMENT

Figure 1:
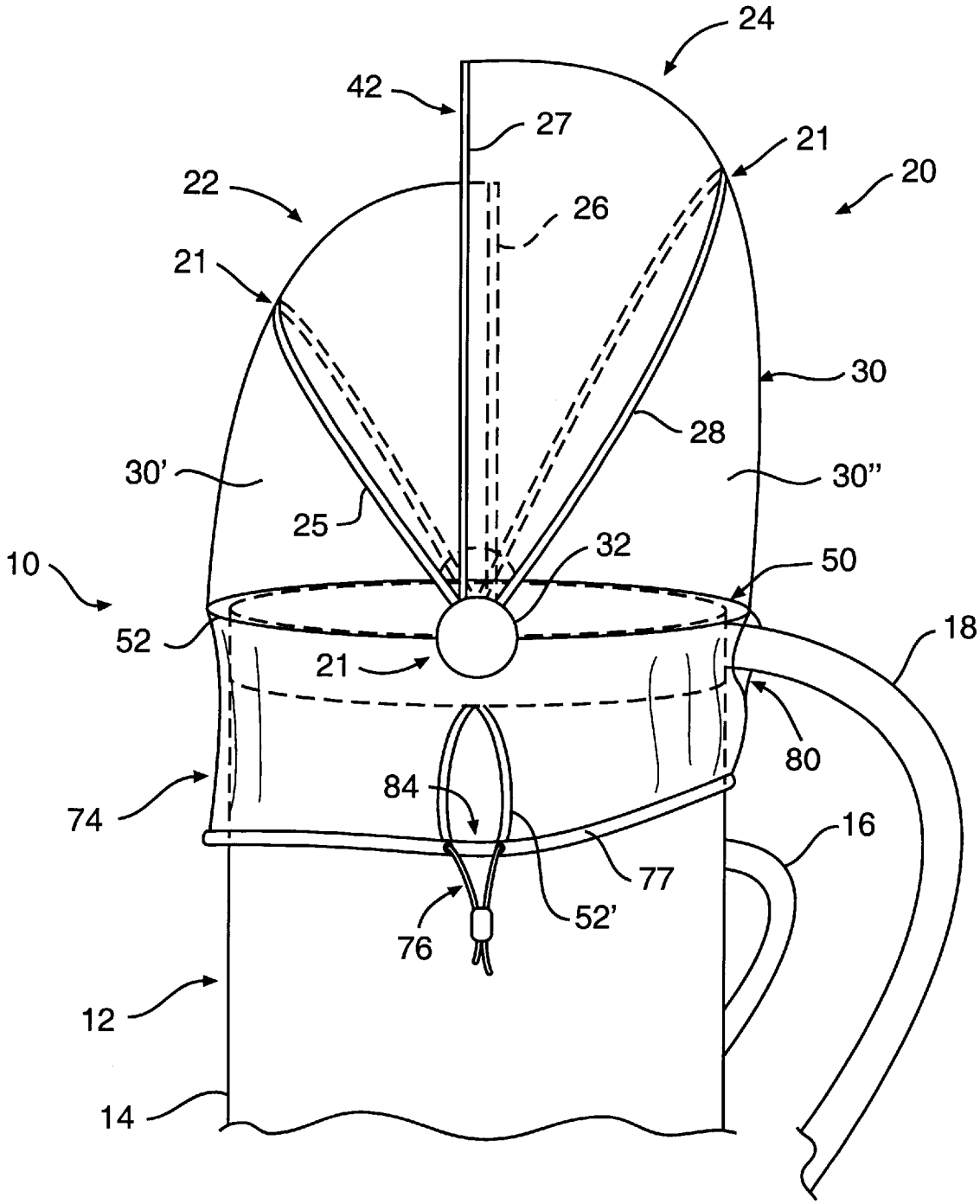
FIG. 1-A is a perspective view of a conventional golf bag illustrated utilizing additional structure to permit the bag to assume a generally upright, tripod-like position on the ground.
Figure 1A:
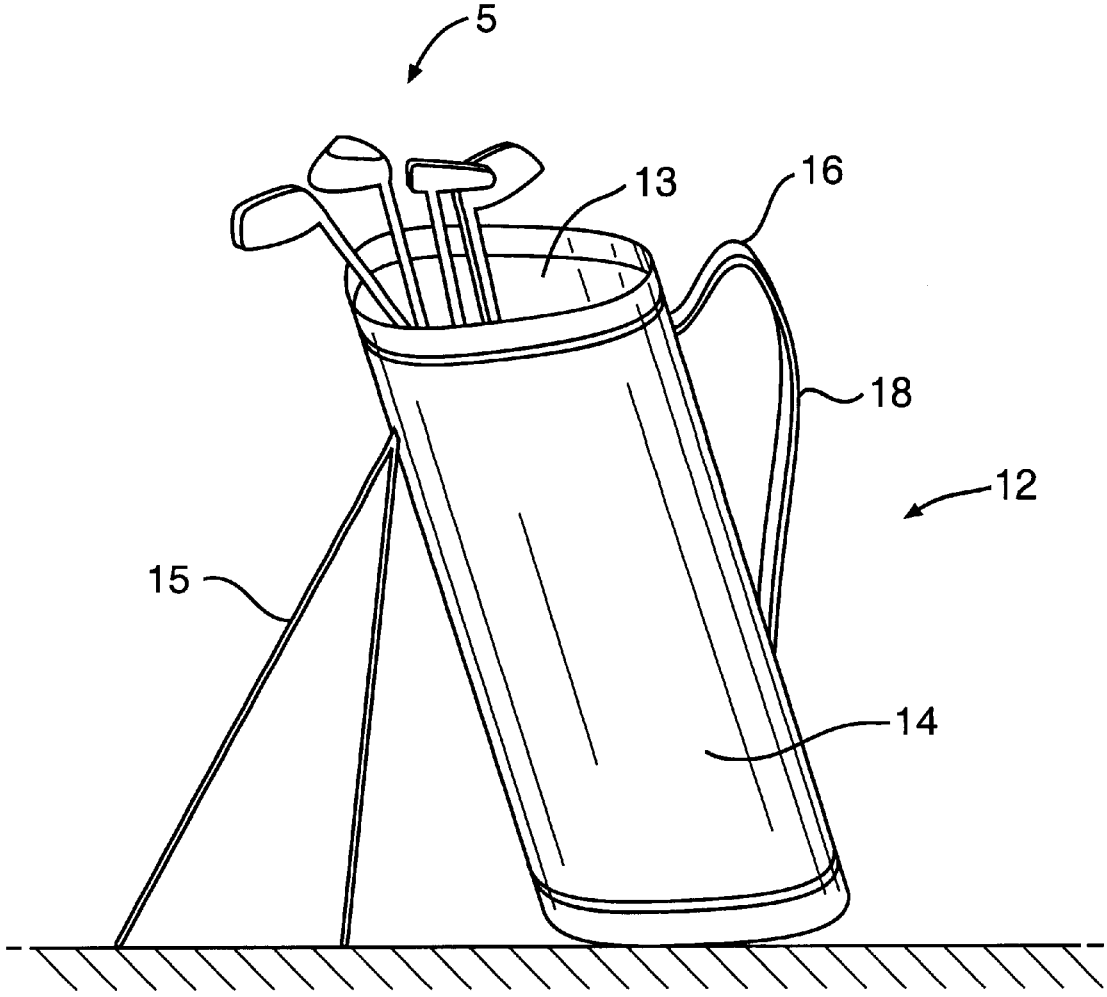
FIG. 1A PRIOR ART

As shown in the accompanying drawings, the present invention relates to a protective cover assembly, generally indicated by reference numeral 10, designed to be used in combination with a golf bag, generally indicated by reference numeral 12, which may have any number of different sizes and configurations. As illustrated in FIG. 1-A, the golf bag 12 may be of a somewhat conventional design which includes an elongated housing, 14, having a closed bottom end and an open upper end 13, into which a plurality of golf clubs, generally indicated by reference numeral 5, may be placed. Other features often associated with modern day golf bags include an outwardly protruding handle 16, often secured thereto by means of sewn stitching, etc., and/or an attached shoulder strap, 18, and/or a support leg assembly, 15 disposed at a front portion of the golf bag 12 and extending outwardly and downwardly therefrom so as to maintain the golf bag, 12 in a somewhat upright orientation, without being supported by a player or an attendant.

Figure 2:
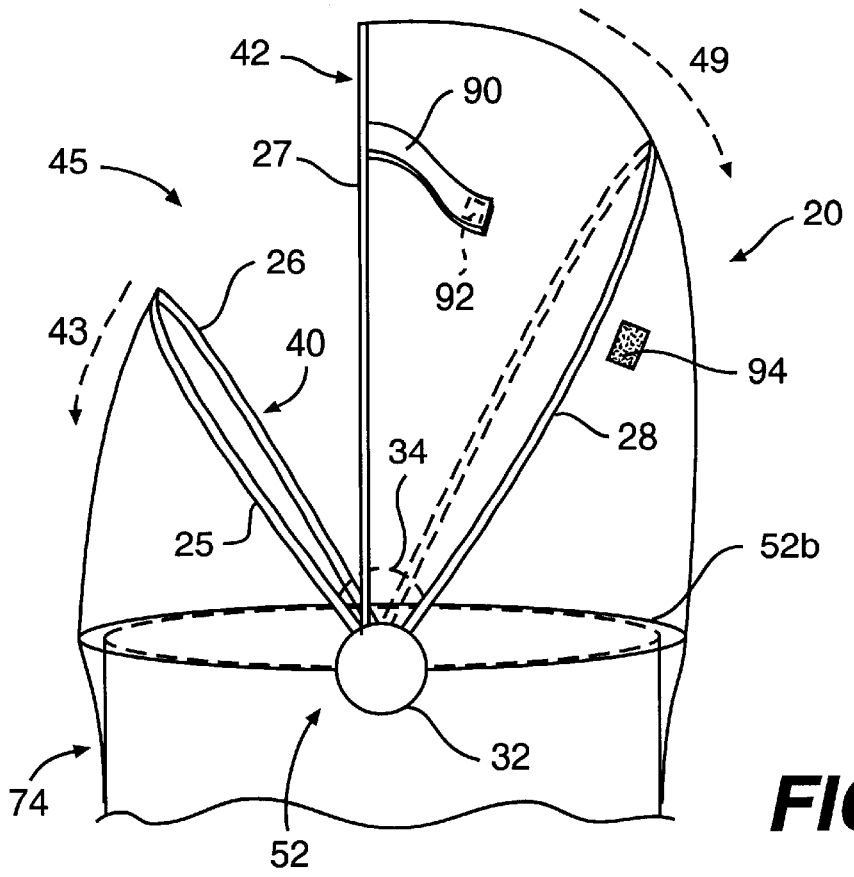
FIG. 2 is a partial perspective view of the invention shown in FIG. 1 disposed in an operative, open position.
Figure 3:
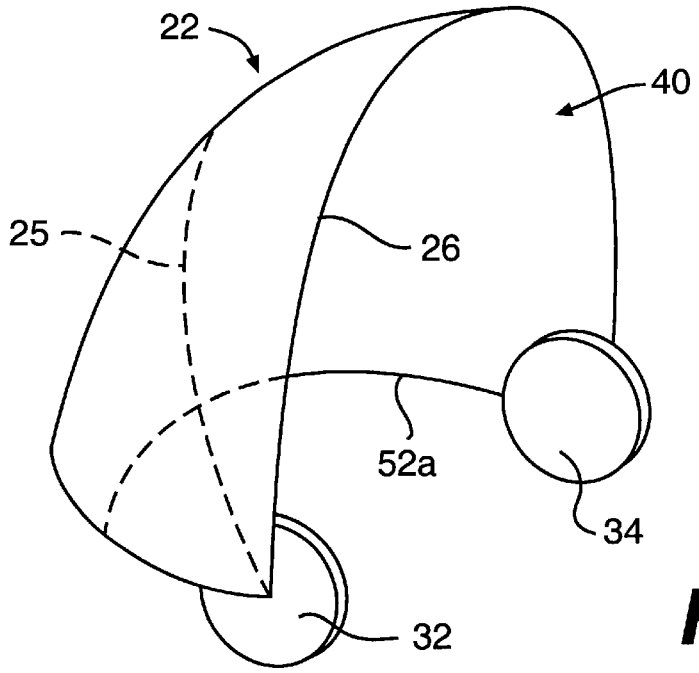
FIG. 3 is a perspective view of one component of the embodiment illustrated in FIGS. 1 and 2.

As shown in FIG. 1, the protective cover assembly 10 of the present invention is structured to be removably attached to the open end of the golf bag, and to be disposed in covering relation to the clubs within the golf bag so as to prevent their exposure to rain or other adverse weather conditions. Accordingly, the protective cover assembly 10 comprises a hood assembly 20 structured to at least partially enclose the open end 13 of the golf bag 12 with golf clubs 5 contained therein. Referring now to FIGS. 1 and 2, the hood assembly 20 preferably comprises a first hood segment 22 and a second segment 24. As will be described in more detail subsequently, the two hood segments 22 and 24 are selectively positionable between a closed position generally represented in FIG. 1 and an open position, at least partially represented in FIG. 2.

Still referring to FIGS. 1 and 2, the hood assembly 20 is seen to comprise a support frame, generally indicated by reference numeral 21, and a cover structure 30. The support frame 21 preferably comprises a plurality of rib structures, such as but not limited to those indicated by reference numerals 25, 26, 27, and 28, which support a cover structure 30 in overlying and at least partially enclosing relation to the open end 13 of the golf bag 12, such that the interior of the golf bag 12 and any clubs 5 protruding through the open end thereof, are substantially if not completely protected from rain or other adverse weather conditions. Each of the ribs structures 25, 26, 27 and 28 associated with the two hood segments 22 and 24 have first and second oppositely disposed ends and a main length therebetween with preferably a generally flat and elongated configuration, as will be further described below. Further, the rib structures 25, 26, 27, 28 are preferably structured and disposed to span over the open end 13 of the golf bag 12 in spaced relation to one another, and accordingly, the opposite extremities of each of the ribs 25, 26, 27, and 28 are fixedly attached, respectively, to oppositely disposed mounting structures, indicated by reference numerals 32 and 34. The mounting structures 32, 34 serve to interconnect the opposite ends of each of the rib structures 25, 26, 27, 28 and also serve to define a portion of a base 50 for the protective cover assembly 10. That is, the mounting structures 32, 34 are preferably also structured and disposed to permit the secure and yet removable attachment of the protective cover assembly 10 into the intended operative position on open end 13 of the golf bag 12, ideally by attaching to a peripheral portion about the open end 13, as shown in FIGS. 1 and 2.

A unique feature of the present invention is that each of the rib structures 25, 26, 27, and 28 are preferably formed from a rigid, and yet flexible, resilient material. Preferably, the material used will be a metallic material such as, but not limited to a non corrosive metal like aluminum, spring steel, or stainless steel, and will be formed to be generally flat with a thin and elongate configuration, although it is contemplated that a suitable plastic material might also be used to accomplish the intended purpose. The rigidity of the material forming rib structures 25, 26, 27, and 28 is sufficient to cause them to assume what may be termed an "upright" orientation, given the rib structures' attachment to mounting structures 32 and 34, which orientation can be overcome by the application of a force to move, bend and/or fold the rib structures into another orientation, such as moving the hood assembly 20 into an open position or into a storage position, each of which will be discussed later. Even so, once such a force is no longer applied, the rigidity of the rib structures 25, 26, 27, 28 is such as to have a biasing memory, meaning that the rib structures will tend to automatically return to the "upright" orientation. Also, by virtue of this resilient construction, each of the rib structures 25, 26, 27, 28 can be formed into the "upright" orientation defined by a generally arcuate configuration by virtue of both of the opposite ends of each rib structure being fixedly attached to one of the mounting structures 32 or 34 as described. Such an arcuate configuration and the collective disposition of these rib structures, as shown in FIGS. 1 and 2, define a disposition in overlying relation, outwardly from and above the open end 13 of the golf bag 12.

In addition, the hood assembly 20 includes a cover structure 30 formed from a flexible material, such as fabric, which is preferably fixed to the exterior of the rib structures 25, 26, 27, 28 and of sufficient dimensions so as to overlie the arcuate "upright" configuration defined thereby and enclose the open end 13 of the golf bag 12. Preferably, the material utilized to form cover structure 30 is specifically structured to be at least partially, if not completely, impermeable to water and rain, and other adverse weather conditions, and as such, can be formed from a nylon fabric or like material. More preferably, the cover structure 30 comprises two separate cover segments 30' and 30", so as to correspond to the first hood segment 22 and the second hood segment 24, respectively. By virtue of this supported disposition on the plurality of rib structures 25, 26, 27, 28, the cover structure 30 protects not only the plurality of golf clubs 5 extending through the open end 13, but also protects or shields the interior of the golf bag 12 from exposure to rain, even during windy conditions and other adverse weather conditions. In addition, the cover structure 30 is of a sufficient size to carry and display indicia or advertising thereon, such as but not limited to a company or country club logo, team logos, player initials, and the like.

As has been described, the preferred hood assembly 20 for the present invention comprises a first hood segment 22 and a second hood segment 24. In a most preferred embodiment, these hood segments 22 and 24 are structured and disposed such that one hood segment, such as 22, is smaller in dimension that the other, such as hood segment, 24, and further, such that an open face of each hood segment is in generally confronting relation to one another, as illustrated in FIGS. 1 and 2. Accordingly, in this more preferred embodiment, the rib structures such as 25 and 26 which define the first hood segment 22, are each sized to be shorter in length than the rib structures, such as 27 and 28 which define the second hood segment 24. It should be pointed out that the pair of rib structures 25, 26 comprising the first hood segment may be generally close but not identical in length to each other, which is also true of the pair or more of rib structures 27, 28 which make up the second hood segment 24, as this feature will further help to define the "upright" orientation of the hood assembly 20. Thus, in the more preferred embodiment, the second hood segment 24 will have a larger "upright" orientation than that of first hood segment 22, and further, the large second hood segment 24 will at least partially overlap the smaller, first hood segment 22 when the hood assembly 20 is disposed in the operative position on a golf bag, and in particular, in the closed position illustrated in FIG. 1. The overlapping orientation is further defined by the open front faces, indicated by reference numerals 40 and 42 in FIG. 2, of each of the hood segments 22, 24 being disposed in somewhat confronting relation to one another. As such, it should be apparent from viewing FIG. 1 that the open end 13 of the golf bag 12, as well as its interior and any clubs 5 protruding therefrom, are substantially if not completely enclosed by the preferred hood assembly 20, and thereby, are protected from exposure to rain or the like. However, because of the flexible, resilient material from which the rib structures 25, 26, 27, 28 are formed, the hood assembly 20 can selectively be positioned into what may be referred to as the open position, which is best pictured in FIG. 2, and which will now be described.

As illustrated in FIG. 2, the hood assembly 20 can be selectively positioned into an open position whereby a golfer can readily access the interior of the golf bag 12, and more specifically, to select and remove an appropriate golf club housed therein, relative to a particular distance he desires to move the golf ball down the fairway. The positioning of the hood assembly 20 in the open position may occur by effectively "collapsing" the rib structures of one hood segment, such as 27 and 28 upon one another, thereby creating a space, as at 45 between the hood segments 22 and 24. More preferably, the golfer may access one or more of the plurality of golf clubs 5 by gently moving a top or uppermost rib structure, such as 26, downwardly and into a stacked relation adjacent rib structure 25, to create the space of void 45 illustrated in FIG. 2, or by moving both rib structures 26 and 25 downwardly even further into adjacent, stacked relation relative to base 50, to create a void or space which is larger than that illustrated in FIG. 2. However, it should be apparent that either or both of the hood segments 22 and 24 may be physically positioned such that the respective rib structures may be moved towards one another in the collapsed position. Directional arrows, indicated by reference numerals 48 and 49 are indicative of the selective, forced positioning of the rib structures 25, 26 and/or 27, 28 respectively. It should be noted, however, that disposition of one of the hood segments in the aforementioned collapsed position, to create the space 45, is normally sufficient to provide adequate access to the interior of the golf bag and the clubs protruding therefrom.

The protective cover assembly 10 of the present invention further comprises a base 50. As has been referred to previously, the base 50 is at least partially defined by two mounting structures 32 and 34 which comprise a mounting assembly for the hood assembly 20, as described above. In one embodiment, the base 50 also includes an at least partially surrounding brace member, indicated by reference numeral 52, which serves to at least partially interconnect the mounting structures 32 and 34. Preferably, the brace member 52 may comprise a first brace segment **52*a* and a second brace segment 52*b*, each formed of a rigid, and yet flexible, resilient material, which ideally is similar to those utilized as rib structures 25, 26, 27, 28. In this embodiment, opposite ends of each one of the brace segments 52*a*, 52*b* are securely mounted to one of the mounting structures 32, 34 and further, each brace segment is sized and configured to extend generally arcuately therebetween about the periphery of open end 13 of the golf bag 12 in generally matching relation to the size of the corresponding hood segment 22 or 24. Also in this embodiment, each cover structure 30' and 30" defining the first and second hood segments 22, 24**, respectively, is sized and configured to extend around and/or beyond and is attached to the corresponding brace segment 52*a* or 52*b*. In an alternative, more preferred embodiment, the brace member 52 may be absent from the protective cover assembly 10, with supportive attachment of the hood assembly 20 occurring by interconnection of the cover structure 30 as well as the plurality of ribs 25, 26, 27, 28 directly to the mounting structures 32 and 34 and about the open end 13 of the golf bag 12.

Figure 5:
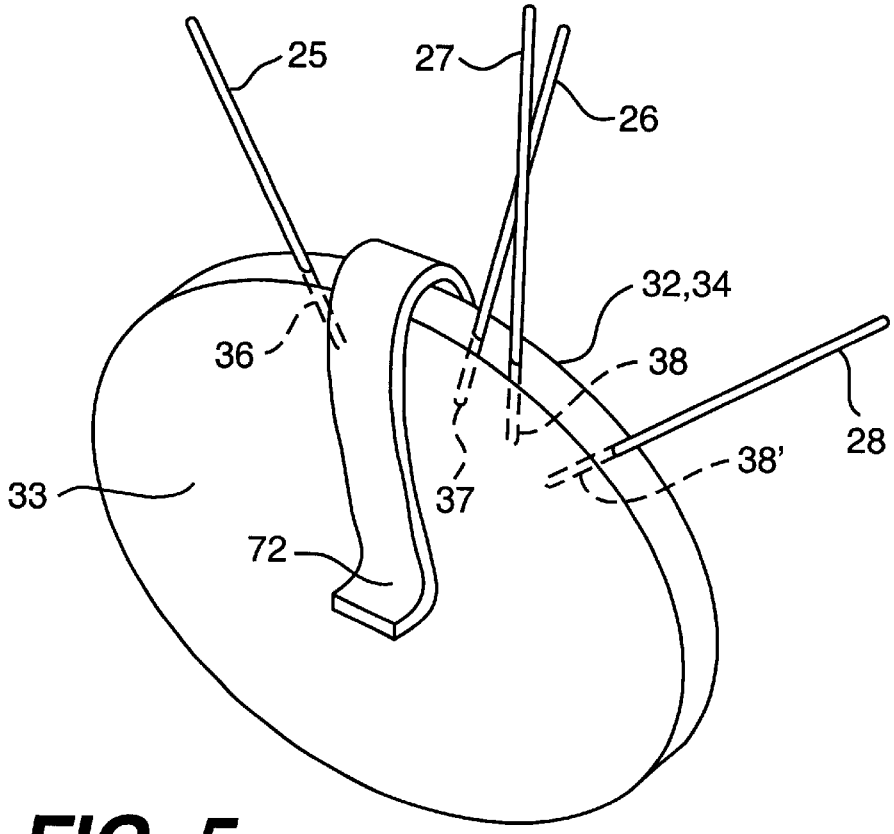
FIG. 5 is a perspective view in partial cutaway of a structural component of the present invention in a preferred embodiment.
Figure 6:
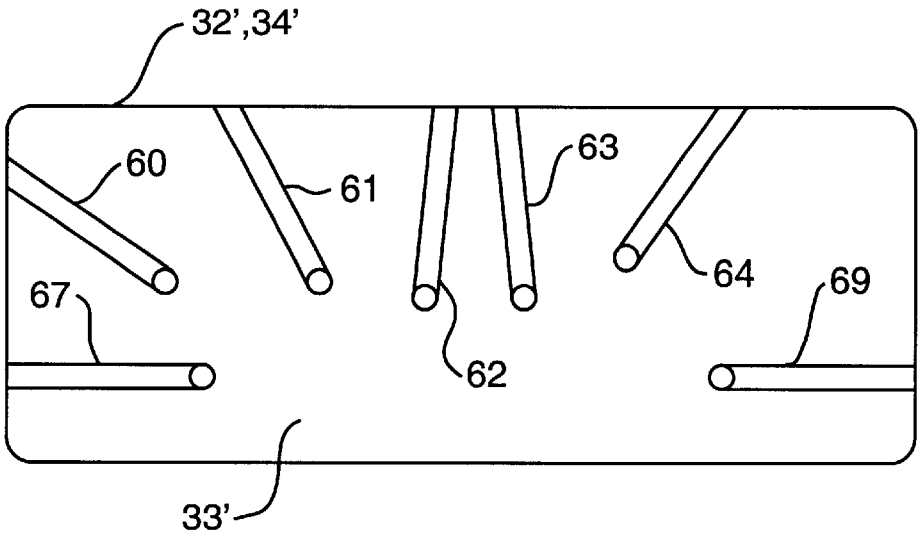
FIG. 6 is a front view of an alternative embodiment for the structural component illustrated in FIG. 5.
Figure 7:
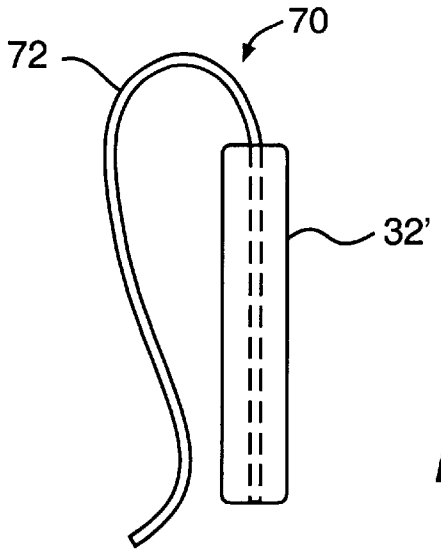
FIG. 7 is a side view of the embodiment of FIG. 6.
Figure 8:
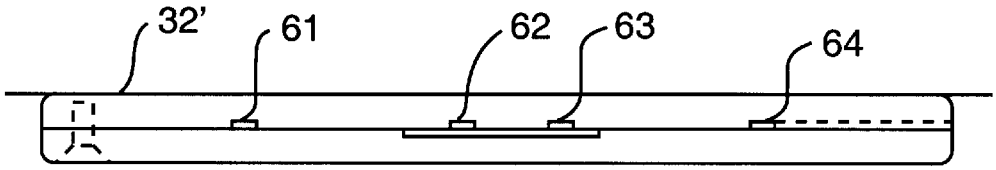
FIG. 8 is a top-view of the embodiment of FIG. 6.

Referring now to FIG. 5, the mounting structure 32 or 34 is illustrated in a preferred embodiment. More in particular, each of the mounting structures 32 and 34 may take the form of a generally circular, disk-like body 33 formed of a rigid yet preferably relatively lightweight material, having a plurality of channels 36, 37, 38 and 38' formed therein for the fixed placement of correspondingly positioned ends of the various rib structures 25, 26, 27, 28. The channels 36, 37, 38 and 38', which are preferably equal in number to the number of rib structures 25, 26, 27, 28, are each formed and disposed on body 33 so as to permit each rib structure to define the generally arcuate configuration which defines the aforementioned hood assembly and/or first and second hood segments 22 and 24. With reference to FIGS. 6–8, the mounting structure 32' or 34' is depicted in an alternative, preferred embodiment which may have a generally flat and rectangular configuration 33', although other configurations such as a square, hexagon, etc. might also be utilized. Here again, it is preferred that each of the ends of each of the ribs 25, 26, 27, 28 be fixedly secured to oppositely disposed mounting structures, such as 32' or 34' and accordingly, channels such as 60, 61, 62, 63, and 64, are preferably formed in the body 33, which are structured and disposed to receive an end region of said ends therein, which can be secured therein whether by means of glue or friction fitting, or other means known in the relevant art. It is to be understood that both of the mounting structures 32, 34 of FIG. 5 and 32', 34' of FIGS. 6 through 8 have an adequate number of channels as shown in FIG. 6 to fixedly secure correspondingly positioned ends of the rib structures 25, 26, 27, 28, etc.

Referring now to FIGS. 5 and 7, each of the mounting structures 32, 34 or 32', 34' is seen to include a connecting structure, generally indicated by reference numeral 70. In a preferred embodiment, the connecting structure 70 is in the form of a clip 72 which is inherently biased to a grip a peripheral edge of the golf bag 12, when disposed in such a position. The preferred clip 72 includes a first proximal end which is fixedly secured to or integrally formed with one face of the mounting structure 32 or 34, and a main length and distal end which extend at least partially outward therefrom, and downwardly therefrom, in a somewhat conventional fashion. The preferred clip 72 is structured and disposed to securely and yet removably support the entire protective cover assembly 10 in its intended operative position relative to the open end 13 of the golf bag 12, by being removably attached to a periphery thereof.

Figure 4:
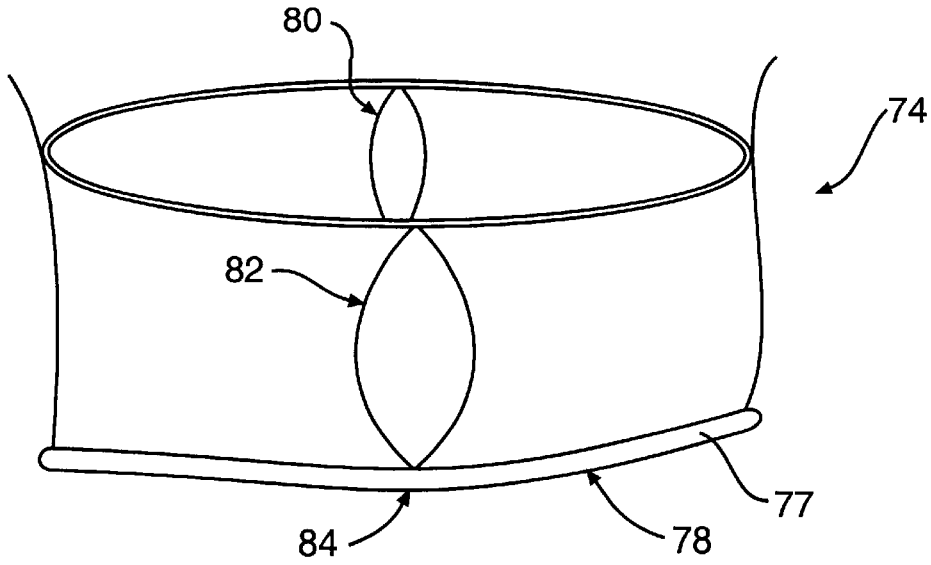
FIG. 4 is a perspective view of another structural component of the embodiment illustrated in FIGS. 1 and 2.

In another preferred embodiment, the protective cover assembly 10 of the present invention includes a skirt portion, generally indicated by reference numeral 74 and illustrated in FIGS. 1, 2 and 4. Preferably, the skirt portion 74 is formed of the same material as cover structure 30, and may merely be an extension thereof. Alternatively, the skirt portion 74 may be connected in somewhat depending or suspended relation from the base 50 of the hood 20, and in any event, will be sized and configured to overlie an exterior surface of the golf bag 12, generally adjacent to the open end 13 thereof. The skirt portion 74, in one embodiment shown in FIG. 1, includes a securing means 76, which may be used to removably secure the outer or lowermost periphery 77 in tight, fitted engagement about the exterior surface of the golf bag 12. The securing means 76 may preferably be of Velcro®. A preferred embodiment of the skirt portion 74, shown in FIG. 4, includes the provision of an elastic band, 78, or like structure, which when secured about the exterior surface of golf bag 12 defines a snug engagement therewith, at least about the lower periphery 77 of the skirt portion 74.

With reference to FIG. 4, in a more preferred embodiment, the skirt portion 74 includes at least one, but preferably a plurality of openings formed therein, such as at 80 and 82. These openings 80 and 82 are formed in the wall of the skirt portion 74, which may include a hook and loop type fastener as at 84, to permit the opening and closing of the outermost ends of each of the openings 80 and 82. The openings 80 and 82 may therefore be positioned in surrounding engagement with the various structural components of the golf bag 12 such as but not limited to a shoulder strap 18, handle 16 or other supporting leg structures 15. Fasteners 84 may be structured to include snaps, zippers, hooks, etc., and are not intended to be limited to a hook and loop type fastener.

As has been described, the hood assembly 20 of the present invention is structured and disposed to permit selective positioning of the assembly between an open position, seen in FIG. 2, and a substantially, if not completely closed and protective position illustrated in FIG. 1. It should be pointed out, however, that due to the flexible and resilient material from which each of the rib structures 25, 26, 27, 28 are formed, and further due to the fact that the opposite ends of these rib structures are fixedly attached to the mounting structures 32 and 34, there is an inherent biasing of the preferred first and second hood segments 22 and 24 into the closed position of FIG. 1. Further, when a golfer applies a force to move one of the hood segments 22 and 24 into a partially open position, seen in FIG. 2, or a more fully open position, as has been described, by collapsing the pertinent rib structures 25, 26 and/or 27, 28 about themselves, the inherent biasing referred to herein serves to automatically urge or bias each of rib structures of the hood segments 22 from the previously oriented open position of FIG. 2 to the closed position of FIG. 1, as soon as the force is no longer applied.

Also, should the protective cover assembly 10 be utilized on a golf bag 12 during a golf outing on a rainy day, for example, and should it stop raining for a short time, it is expected that the golfer may not wish to remove and store the rain cover of the invention for fear that it will soon begin to rain again. As such, the protective cover assembly 10 is preferably structured and disposed to include means 90 for selectively and releasably holding the hood assembly 20 in an open position described above, and as shown in FIG. 2. Preferably, the holding means 90 comprises at least one strip of fabric material, ideally a relatively thin and short strip of material similar to that utilized in forming cover structure 30, which is either permanently or temporarily secured at a first proximal end to the cover structure 30 of one of the hood segments 22 and/or 24, generally at or adjacent the rib structure 27 or 26, and which includes connecting means 92 at a distal end thereof. The connecting means 92 preferably comprises a hook and loop type of fastener which will mate with additional connecting means 94 which are preferably disposed an appropriate distance away on cover structure 30, such as indicated by reference numeral 94 in FIG. 2, although other connecting means, such as mating snaps, a button and button hole, etc, could also be utilized for this purpose. Ideally, the strip 90 and connecting means 92, 94 are disposed at or near a top side on the hood segment 22 or 24, so that only one strip is needed, although two such strips might be used on each side of a hood segment 22, 24. Also, it should be pointed out that both hood segments 22, 24 may be provided with such structures 90, 92, 94 so as to permit a more fully open position, if that is desired. In this way, a golfer can selectively move, for instance, the rib structure 27 of the larger hood segment 24 into collapsed or stacked relation to rib structure 28 so as to dispose the hood assembly 20 in at least a partially open position, and then, can pull on the strip of fabric 90 and attach the connecting means 92, 94 together so as to temporarily maintain the hood assembly 20 in that position. Thus, continuing with this example, should it begin raining again a while later during the golf outing, the golfer can simply and easily release the connecting means 92, 94 holding the preferred strip of material 90 and the hood segment 22 or 24 in the open position, and the hood assembly will automatically resume the closed position illustrated in FIG. 1.

Figure 9:
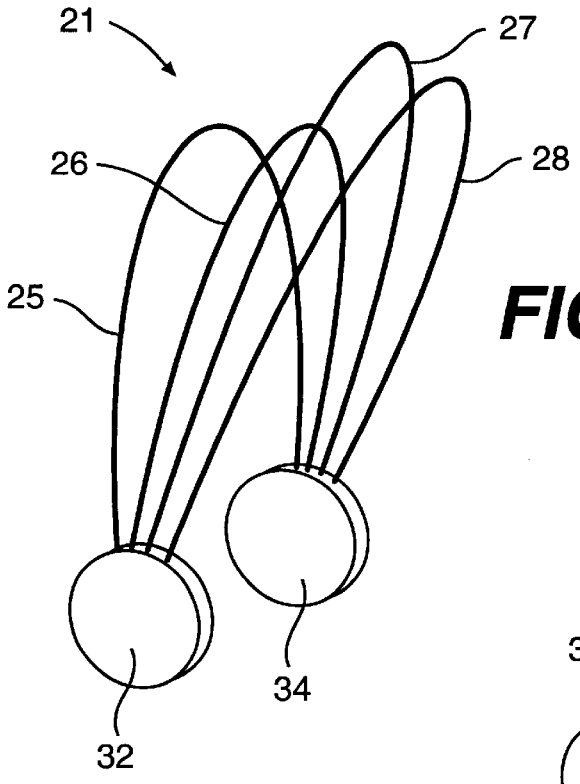
FIG. 9 is a perspective view of a support frame portion of the cover assembly of the present invention disposed in a partially stored position.
Figure 10:
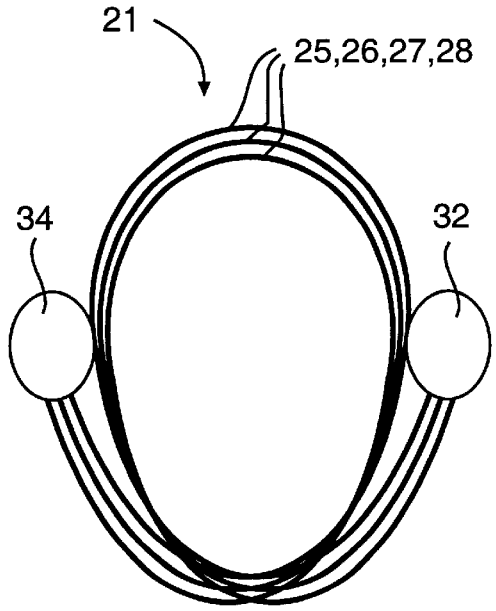
FIG. 10 is a perspective view of the structural embodiment of FIG. 9 in a preferred stored position.
Figure 11:
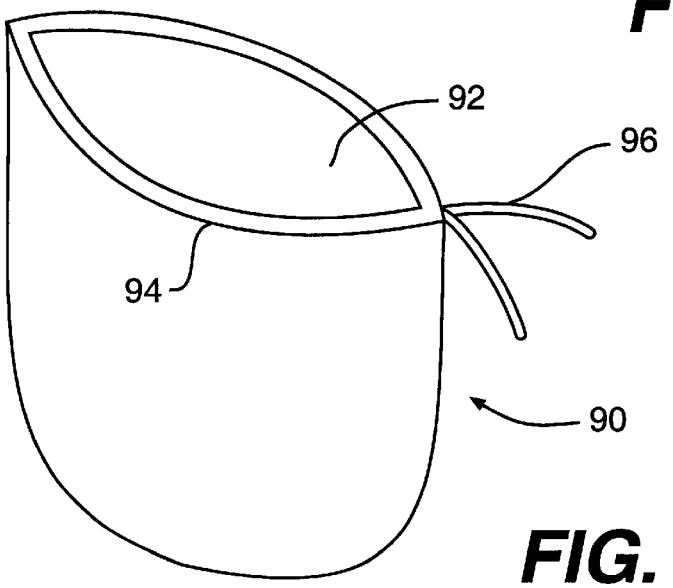
FIG. 11 is a perspective view of another embodiment of the present invention.

With reference now to FIGS. 9–11, another feature associated with the flexible, resilient nature of the plurality of rib structures 25, 26, 27 and 28 is the ability of the protective cover assembly 10 to assume a compact storage position. This stored position may be defined generally by an "open loop" type configuration wherein the plurality of rib structures 25 through 28 are first collectively collapsed about themselves, as shown in FIG. 9, into a somewhat aligned or overlapping relation to one another. Once so positioned, the plurality of rib structures, including the fixedly attached mounting structures 32 and 34 are bent or "folded" to assume the "open loop" configuration of FIG. 10. It should be apparent that the stored position shown in FIG. 10 defines a significantly reduced size and configuration of the hood assembly 20 thereby facilitating storage of the hood assembly 20 in a convenient location.

In a more preferred embodiment, the protective cover assembly 10 includes a casing 90 for the convenient storage and transport of the assembly in the stored position described above. The casing 90 preferably is formed to have a hollow interior 92 and an open passage 94 formed generally about one peripheral portion thereof. A draw string or like closure structure 96 may be structured and directly connected to the periphery 94 so as to selectively allow opening and closing of the casing 90. Further, the open passage 94 of the casing 90 is dimensioned and configured to allow passage therethrough of the hood assembly 20, when in the stored position of FIG. 10, due to the aforementioned significantly reduced size and configuration thereof. For purposes of clarity, the depiction of the hood assembly 20 in both FIGS. 9 and 10, discloses the relative positioning of the rib structures 25, 26, 27, 28 defining the support frame. It should be apparent, however, that the flexibility of the material from which the cover structure 30, and more particularly the cover segments 30' and 30" are formed, allow the cover structure 30 to be folded onto itself and to assume an adaptable orientation relative to the specific formation and positioning of the plurality of ribs 25, 26, 27, and 28 into the "open loop"0 configuration of FIG. 10.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents. Now that the invention has been described,

What is claimed is:

1. A cover assembly for a golf bag, said cover assembly comprising:

a) a base adapted to be removably secured to the golf bag substantially adjacent an open end of the golf bag; and b) a hood assembly connected to said base and selectively positionable between a closed position and an open position, c) said hood assembly including a support frame secured to and extending outwardly from said base substantially adjacent to and above the open end of the golf bag, d) said hood assembly further including at least two hood segments supported on said support frame wherein said support frame is positioned and resiliently biased to maintain said at least two hood segments in substantially overlying, protective relation to the open end of the golf bag, e) said closed position defined by orientation of said at least two hood segments in said substantially overlying, protective relation to the open end, and f) said open position defined by orientation of said at least two hood segments out of overlying relation to at least a portion of the open end.

2. An assembly as in claim 1 wherein said support frame includes means for normally orienting said hood assembly in said closed position when mounted on the golf bag.

3. An assembly as in claim 2 wherein said support frame further includes means for biasing said hood assembly into said closed position when said hood assembly is oriented in said open position.

4. An assembly as in claim 3 wherein said support frame is formed at least in part of a substantially resilient material and movable relative to said base when said hood assembly is disposed between said open and closed positions.

5. An assembly as in claim 2 wherein said support frame comprises a plurality of ribs connected to said base and disposed in normally spaced relation to one another and in supporting engagement with said cover structure.

6. An assembly as in claim 5 wherein each of said plurality of ribs are formed from at least a flexible, resilient material disposed in outward, substantially overlying relation to the open end and collectively configured to orient said cover structure in overlying relation to the open end.

7. An assembly as in claim 6 wherein said plurality of ribs are structured and collectively disposed to normally orient said hood assembly in said closed position and bias said hood assembly toward and into said closed position when said hood assembly is oriented in said open position.

8. An assembly as in claim 5 wherein said hood assembly comprises two hood segments each connected to said base in movable relation to one another and relatively disposable to define orientation of said hood assembly in either said open position or closed position.

9. An assembly as in claim 8 wherein said open position is at least partially defined by a separated orientation of said two hood segments and a disposition of at least one of said two hood segments in overlying, enclosing relation to a portion of the open end.

10. An assembly as in claim 1 wherein said support frame is cooperatively structured with a remainder of said hood assembly to be selectively disposed in a stored position at least partially defined by a substantially reduced dimension and configuration of said hood assembly.

11. An assembly as in claim 10 further comprising a casing having a hollow interior and dimensioned and configured to receive said hood assembly therein when said hood assembly is in said stored position.

12. An assembly as in claim 1 wherein said base comprises at least one mounting assembly structured to be removably attached to the golf bag adjacent the open end thereof.

13. An assembly as in claim 1 further comprising a skirt portion connected to and depending from said base in overlying relation to an exterior surface of the golf bag substantially adjacent to the open end thereof.

14. An assembly as in claim 13 wherein said skirt includes at least one opening formed therein and being structured to receive and allow passage of a protruding portion of the golf bag through said skirt.

15. An assembly as in claim 14 wherein said skirt includes a plurality of openings formed therein in spaced relation to one another, each of said openings being structured to receive and allow passage of a different protruding portion of the golf bag through said skirt at spaced apart locations from one another.

16. An cover assembly for a golf bag, said cover assembly comprising:

a) a base adapted to be removably secured to the golf bag substantially adjacent an open end of the golf bag; and b) a hood assembly connected to said base and selectively positionable between a closed position and an open position, c) said hood assembly including a support frame secured to and extending outwardly from said base substantially adjacent to and above the open end of the golf bag, said support frame includes means for normally orienting said hood assembly in said closed position when mounted on the golf bag, d) said hood assembly further including at least two hood segments supported on said support frame wherein said support frame is positioned and resiliently biased to maintain said at least two hood segments in substantially overlying, protective relation to the open end of the golf bag, each of said at least two hood segments connected to said base in movable relation to one another and relatively disposable to define orientation of said hood assembly in either said open position or closed position, e) said closed position defined by orientation of said at least two hood segments in said substantially overlying, protective relation to the open end, and f) said open position defined by orientation of said at least two hood segments out of overlying relation to at least a portion of the open end, and said open position is at least partially defined by a separated orientation of said at least two hood segments and a disposition of at least one of said at least two hood segments in overlying, enclosing relation to a portion of the open end, wherein said support frame comprises a plurality of ribs connected to said base and disposed in normally spaced relation to one another and in supporting engagement with said at least two hood segments, each hood segment comprises at least one of said plurality of ribs formed from at least a flexible, resilient material, said ribs of each hood segment structured and collectively disposed to normally maintain said hood assembly in said closed position and bias said hood assembly towards and into said closed position when said hood assembly is oriented in said open positions.

17. An assembly as in claim 16, wherein said closed position of said hood assembly is further defined by each hood segment disposed in overlying and enclosing orientation relative to a different portion of the open end of the golf bag.

18. A cover assembly for a golf bag comprising:

a) a base adapted to be removably secured to the golf bag substantially adjacent an open end thereof; and b) a hood assembly connected to said base and positionable between an open position and a closed position relative to the open end of the golf bag, c) said hood assembly including a support frame and at least two hood segments mounted in supported relation on said support frame in overlying relation to the open end, d) said support frame comprising a plurality of ribs connected to said base in normally outwardly spaced relation to one another and extending outwardly from the open end, e) said plurality of ribs formed from at least a flexible, resilient material and collectively disposed to normally maintain said hood assembly in said closed position and bias said hood assembly toward and into said closed position when said hood assembly is oriented in said open position, f) said closed position defined by orientation of said at least two hood segments in substantially enclosing relation to the open end, and g) said open position defined by orientation of said at least two hood segments out of overlying relation to at least a portion of said open end, wherein each of said plurality of ribs comprises a substantially arcuate configuration having opposite ends fixedly secured to said base and disposed in spanning relation to the open end, said plurality of ribs being movable relative to one another upon disposition of said hood assembly between said open and closed positions.

19. An assembly as in claim 18 wherein said hood assembly comprises two hood segments each including at least one of Said plurality of ribs, at least one of said two hood segments movable relative to the other of said two hood segments to define said open and closed positions.

20. An assembly as in claim 19 wherein each of said two hood segments comprises an open face disposable in substantially confronting relation to one another and an opening disposed in communicating relation to a different portion of the open end of the golf bag.

21. An assembly as in claim 20 wherein one of said two hood segments comprises a greater length than a length of the other hood segment, said one hood segment disposed above and in substantially overlapping relation to the other hood segment when said hood assembly is in said closed position.

22. An assembly as recited in claim 19 wherein said hood assembly further comprises means for selectively and releasably holding the hood assembly in said open position.

23. An assembly as in claim 18 wherein said plurality of ribs have sufficient flexibility to allow orientation of said hood assembly in a substantially open ended loop configuration of substantially reduced overall dimension to define a stored position.

24. An assembly as in claim 23 further comprising a casing having a hollow interior and dimensioned and configured to receive said hood assembly therein when aid hood assembly is in said stored position.

* * * * *